US010617170B1

(12) United States Patent
Arnold

(10) Patent No.: US 10,617,170 B1
(45) Date of Patent: Apr. 14, 2020

(54) SANDAL OR SLIP-ON FOOTWEAR WITH IMPROVED OPTIONAL-USE HEEL STRAP AND RELATED METHODS

(71) Applicant: Stephen Arnold, San Diego, CA (US)

(72) Inventor: Stephen Arnold, San Diego, CA (US)

( * ) Notice: Subject to any disclaimer, the term of this patent is extended or adjusted under 35 U.S.C. 154(b) by 0 days.

(21) Appl. No.: 16/450,835

(22) Filed: Jun. 24, 2019

Related U.S. Application Data

(63) Continuation-in-part of application No. 29/695,000, filed on Jun. 14, 2019.

(51) Int. Cl.
*A43B 3/24* (2006.01)
*A43B 3/12* (2006.01)
*A43B 3/00* (2006.01)

(52) U.S. Cl.
CPC ..... *A43B 3/242* (2013.01); *A43B 3/0073* (2013.01); *A43B 3/122* (2013.01); *A43B 3/126* (2013.01)

(58) Field of Classification Search
CPC ..... A43B 3/242; A43B 3/126; A43B 3/122; A43B 3/073; A43B 3/24; A43B 3/12
See application file for complete search history.

(56) References Cited

U.S. PATENT DOCUMENTS 366,266 A * 7/1887 Smithers ..... A43B 23/28 36/58.5
430,982 A 6/1890 Ziegler
459,616 A 9/1891 Von Rohonczy
736,194 A 8/1903 Bassett
950,862 A 3/1910 Nelson
1,110,362 A 9/1914 Whitaker
1,908,433 A 7/1931 Manville
2,024,729 A * 12/1935 Gustin ..... A43B 3/101 36/108
2,112,761 A 3/1938 Buehner
2,233,544 A 3/1941 McKinley
D132,630 S 6/1942 Pfeiffer
2,390,685 A 12/1945 Benson
D147,308 S 8/1947 Steel
2,491,297 A 12/1949 Brown
2,724,913 A 11/1955 Russel
2,736,110 A * 2/1956 Hardinnon ..... A43B 11/00 36/58.5
2,741,039 A 4/1956 Mathews
3,001,302 A 9/1961 Farley
3,011,281 A * 12/1961 King ..... A43B 3/0078 36/11.5
3,047,967 A 8/1962 Hoyt et al.
3,121,962 A 2/1964 Gullo
3,290,802 A 12/1966 Fukuoka
3,336,683 A 8/1967 Schellkopf
3,978,596 A 9/1976 Brown et al.
4,017,987 A 4/1977 Perez, Jr. et al.
4,026,047 A 5/1977 Ahmer
4,051,610 A 10/1977 Shigeji
D260,047 S 8/1981 Heinz
4,461,288 A 7/1984 Curtis
(Continued)

*Primary Examiner* — Shaun R Hurley
*Assistant Examiner* — Bao-Thieu L Nguyen
(74) *Attorney, Agent, or Firm* — Buche & Associates, P.C.; Bryce A. Johnson; John K. Buche

(57) ABSTRACT

Disclosed is slip-on footwear with a concealable heel strap that is padded. Suitably, the padding of the padded heel strap is convertible into a pull-tab whenever the heel strap is concealed.

5 Claims, 4 Drawing Sheets

(56) References Cited

U.S. PATENT DOCUMENTS 4,489,509 A * 12/1984 Libit ..... A43B 1/0018 36/50.1
4,530,171 A 7/1985 Zabala
4,756,097 A * 7/1988 Sanders ..... A43B 5/007 36/72 B
4,813,162 A 3/1989 Harris
D305,176 S 12/1989 Campbell
4,920,664 A 5/1990 McGregor et al.
5,090,140 A * 2/1992 Sessa ..... A43B 11/02 36/138
5,205,071 A 4/1993 Hergenroeder
5,228,216 A 7/1993 Sargeant
D338,320 S 8/1993 Haggar
D374,335 S 10/1996 Grimes
5,615,496 A 4/1997 Sharpstein
5,651,195 A 7/1997 Clancy
6,237,249 B1 5/2001 Aguerre
D448,146 S 9/2001 Jacobs
D452,363 S 12/2001 Mansour
D453,987 S 3/2002 Ray
D465,642 S 11/2002 Petrovski
D465,906 S 11/2002 Petrovski
D495,855 S 9/2004 Comeau
D503,271 S 3/2005 Choi
D508,306 S 8/2005 Armado
D516,280 S 3/2006 Jarmon Mouchi et al.
D523,214 S 6/2006 Jarmon Mouchi et al.
D525,417 S 7/2006 Kelsey
D529,690 S 10/2006 Choi
D556,992 S 12/2007 Choi
D560,346 S 1/2008 Belley et al.
D562,535 S 2/2008 Giorgio
7,331,122 B2 * 2/2008 Januszewski ..... A43B 3/122 36/100
7,439,837 B2 * 10/2008 McDonald ..... A43B 3/126 36/11.5
D594,220 S 6/2009 McDaniel
D596,834 S 7/2009 Tatsuno
D619,795 S 7/2010 McBride
D623,839 S 9/2010 Leleu
7,823,299 B1 * 11/2010 Brigham ..... A43B 3/105 36/100
7,854,638 B2 12/2010 Twombly
D634,105 S 3/2011 Cheshire et al.
D635,757 S 4/2011 Ward et al.
7,980,004 B2 * 7/2011 Klavano ..... A43B 3/122 36/11.5
D654,671 S 2/2012 Coleman
D665,155 S 8/2012 Arnold
D694,995 S 12/2013 Nguyen
9,675,132 B2 * 6/2017 Marshall ..... A43B 11/00
9,820,527 B2 * 11/2017 Pratt ..... A43B 23/28
9,993,045 B2 * 6/2018 Graffeo ..... A43B 13/122
10,159,310 B2 * 12/2018 Sullivan ..... A43B 23/0245
D838,467 S 1/2019 Hughes
2001/0011430 A1 * 8/2001 Davis ..... A43B 11/00 36/138
2006/0075656 A1 * 4/2006 Januszewski ..... A43B 3/122 36/11.5
2006/0090374 A1 * 5/2006 Hillyer ..... A43B 3/103 36/100
2007/0283594 A1 * 12/2007 Sink ..... A43B 3/122 36/11.5
2008/0155860 A1 * 7/2008 Tai ..... A43B 1/0018 36/101
2008/0168682 A1 7/2008 Le
2008/0189984 A1 * 8/2008 Januszewski ..... A43B 3/122 36/100
2010/0107451 A1 * 5/2010 Kay ..... A43B 5/14 36/135
2011/0016751 A1 * 1/2011 Somerville ..... A43B 3/122 36/105
2011/0056091 A1 3/2011 Shmurak et al.
2011/0138518 A1 * 6/2011 Bhalla ..... A41D 19/0044 2/160
2013/0291402 A1 * 11/2013 Bell ..... A43B 1/0081 36/103
2017/0055630 A1 * 3/2017 Marshall ..... A43B 11/00
2017/0181493 A1 * 6/2017 Graffeo ..... A43B 13/122
2018/0289102 A1 * 10/2018 Graffeo ..... A43B 13/122

* cited by examiner

SANDAL OR SLIP-ON FOOTWEAR WITH IMPROVED OPTIONAL-USE HEEL STRAP AND RELATED METHODS

CROSS-REFERENCE TO RELATED APPLICATIONS

Not applicable.

STATEMENT REGARDING FEDERALLY SPONSORED RESEARCH OR DEVELOPMENT

Not applicable.

THE NAMES OF THE PARTIES TO A JOINT RESEARCH AGREEMENT

Not applicable.

REFERENCE TO AN APPENDIX SUBMITTED ON A COMPACT DISC AND INCORPORATED BY REFERENCE OF THE MATERIAL ON THE COMPACT DISC

Not applicable.

STATEMENT REGARDING PRIOR DISCLOSURES BY THE INVENTOR OR A JOINT INVENTOR

Reserved for a later date, if necessary.

BACKGROUND OF THE INVENTION

Field of Invention

The disclosed subject matter is in the field of sandal or slip-on footwear.

Background of the Invention

Slip-on sandals, like flip-flops (e.g., FIG. 1, U.S. Des. Pat. D793,041 (issued Aug. 1, 2017)) or Crocs® (e.g., FIG. 1, U.S. Des. Pat. D535,088 (issued Jan. 16, 2007)), are a stylish and cozy style of footwear. However, slip-on sandals are typically not secured to a user's heel and, as a result, this style of footwear can either make it difficult for a user to make abrupt and complicated footsteps or else easily slip-off during undesirable circumstances. So, some slip-on sandals are provided with an optional-use heel-strap.

One type of optional use heel-strap for slip-on sandals is shown in FIG. 8 of U.S. Des. Pat. D838,467 (issued Jan. 22, 2019). The optional-use heel strap shown in that document is simply stuck to the midsole of a slip-on sandal and provided over a user's heel whenever its utility is desirable. A similar optional-use heel strap that is stuck through a slip-on sandal's upper is shown in FIG. 1 of U.S. D694,994 (issued Dec. 10, 2013). Unfortunately, this type of optional-use heel strap can damage the slip-on sandal and is, therefore, not entirely satisfactory in all situations. This type of strap has other drawbacks too, like, the inability of a user to hide the strap once the strap is placed on the slip-on and the potential for injury if the strap is placed on the slip on in an incorrect manner.

Another type of optional-use heel strap for slip-on sandals (like Crocs®) is shown in FIG. 3 of U.S. D732,808 (issued Jun. 30, 2015). The optional-use heel strap shown in that document is coupled to the upper and placed in a heel position when its utility is desired or else simply rotated out of the way over the sandal's upper when not needed. This type of optional-use heel strap can change the aesthetic appearance of the sandal and is, therefore, not entirely satisfactory in situations where a heel strap is wanted without a corresponding change in the sandal's appearance. Also, this type of heel strap is attached with a metal grommet which can be uncomfortable or rust.

Yet another type of optional-use heel strap for slip-on sandals (like flip flops or Crocs®) is shown in the figures of U.S. Published Pat. App. US2008/0189984 (published Aug. 14, 2008). This type of optional use heel strap is concealed in the sole of a sandal whenever the heel strap is not needed and otherwise exposed when its utility is desirable. A more elaborate version of this type of optional use heel strap is shown in the figures of U.S. Pat. No. 7,823,299 (issued Nov. 2, 2010). This type of optional-use heel strap can be uncomfortable and therefore unsatisfactory in some situations since it is not always possible to conceal a sufficiently padded heel strap in the sole of a slip-on sandal. Also, these types of heel-straps are difficult to reveal once put in a concealed configuration.

SUMMARY OF THE INVENTION

In view of the foregoing, an object of this specification is to disclose slip-on footwear with an improved optional-use heel strap. It is a further objective of this disclosure to provide an optional use heel strap to slip-on footwear without damaging the footwear. It is another objective of this specification to describe footwear with a heel strap that can be used or not used without substantially altering the aesthetic appearance of the footwear. Finally, it is an objective of this disclosure to highlight slip-on footwear with a concealable heel strap that is heavily padded.

In one embodiment, slip-on footwear includes a sole, an upper, and a padded optional-use heel strap concealed within a strap channel disposed around the heel portion of the sole; wherein, the padded portion of the heel strap is folded in half to define a pull-tab that extends from the strap channel of sole for a user to grip the pull-tab to release the strap from the strap channel.

In one mode of use, the slip-on footwear is provided to a foot of a wearer, the pull-tab is pulled to expose the heel-strap, the pull-tab is unfolded to define padding for the strap, and strap is placed over the heel of a wearer with the padding provided to the wearer's heel.

In another mode of use, a wearer of the slip-on footwear pulls the padding of the strap off of the user's heel, folds the padding to define the pull tab, and deposits the heel strap in the strap channel of the sole of the slip-on footwear.

BRIEF DESCRIPTION OF THE SEVERAL VIEWS OF THE DRAWINGS

Other objectives of the disclosure will become apparent to those skilled in the art once the invention has been shown and described. The manner in which these objectives and other desirable characteristics can be obtained is explained in the following description and attached figures in which.

Figure 1:
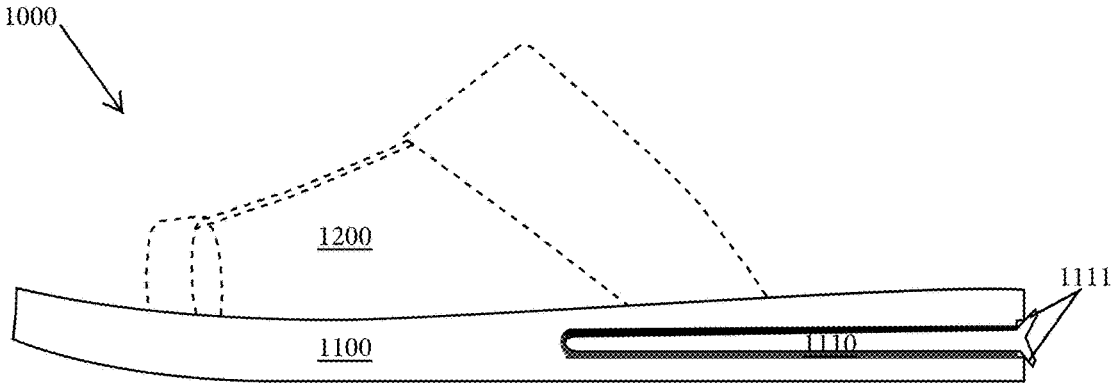
FIG. 1 is a side view of a sandal.

In the figures, the following components are associated with the adjacent reference numerals:

1000 slip-on sandal;
- 1100 sole
  - 1110 optional use strap
    - 1111 pull-tab
    - 1112 heel padding
  - 1120 strap channel
    - 1121 hole
- 1200 upper It is to be noted, however, that the appended figures illustrate only typical embodiments of this invention and are therefore not to be considered limiting of its scope, for the invention may admit to other equally effective embodiments that will be appreciated by those reasonably skilled in the relevant arts. Also, figures are not necessarily made to scale but are representative.

DETAILED DESCRIPTION OF PREFERRED EMBODIMENTS

Disclosed is slip-on footwear with a concealable heel strap that is padded. Suitably, the padding of the padded heel strap is convertible into a pull-tab whenever the heel strap is concealed. The other specifics of the disclosed slip-on footwear with a concealable heel strap are described with reference to the drawings.

Figure 2:
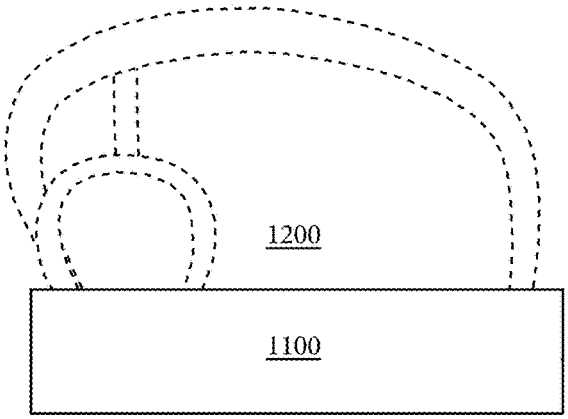
FIG. 2 is a front view of a sandal.
Figure 3:
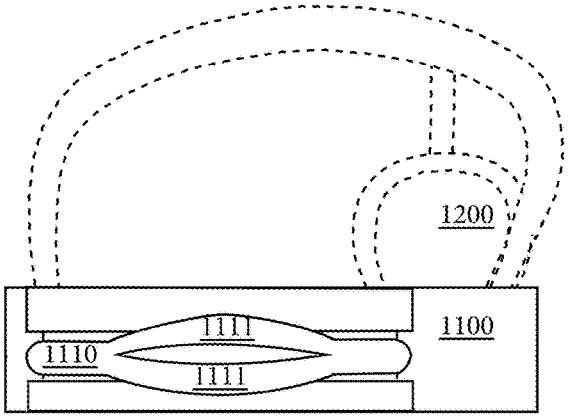
FIG. 3 is a rear view of the sandal.
Figure 4:
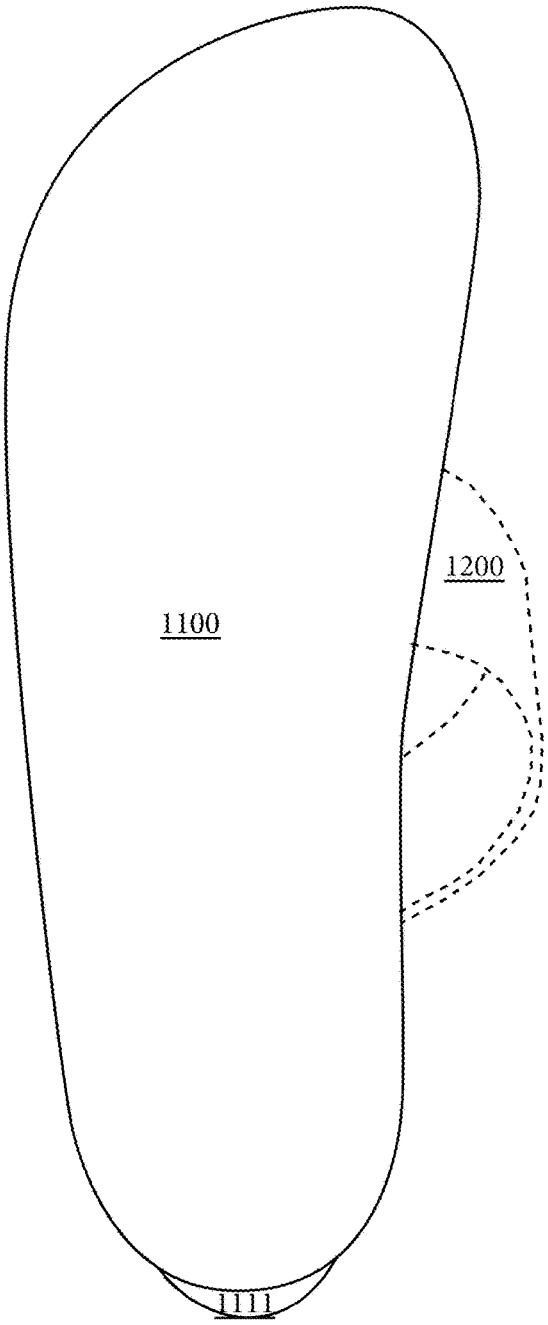
FIG. 4 is a bottom view of a sandal.
Figure 5:
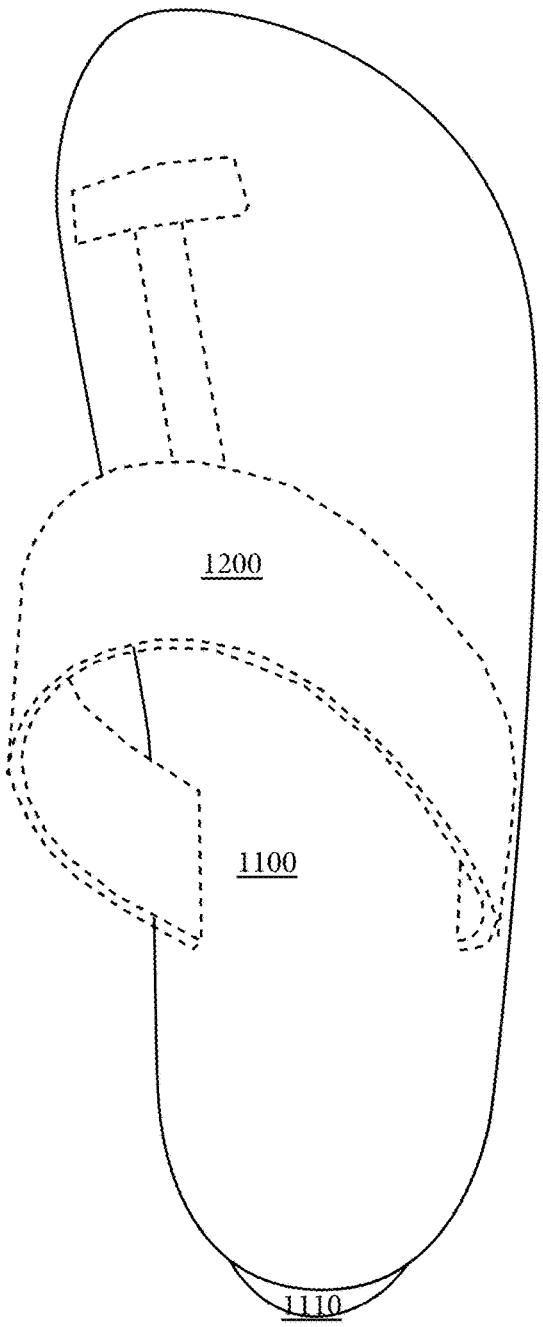
FIG. 5 is a top view of a sandal.

FIG. 1 is a side view of a sandal 1000. FIG. 2 is a front view of the sandal 1000. FIG. 3 is a rear view of the sandal 1000. FIG. 4 is a bottom view of a sandal. FIG. 5 is a top view of a sandal. As shown in FIGS. 1 through 5, the sandal 1000 is comprises a sole 1100, an upper 1200, and a concealed strap 1110 with two pull-tabs 1111.

Still referring to FIGS. 1 through 5, the sole 1100 is best seen in FIGS. 1, 2, 3 and 4, the upper is best seen in FIGS. 1, 2, 3, and 5, and the heel strap 1110 is best seen in FIGS. 1 and 3. As shown, the sole 1110 is typically shaped like a human foot and defined by foam, rubber, or some combination thereof. As best seen in FIG. 4, the upper 1200 is provided to a top surface of the sole 1100. In the preferred embodiment, the upper is defined by a toe hole and a foot strap, the upper can be any type of slip-on known to those of skill in the art. As discussed below in connection with FIGS. 1 and 3, a heel strap 1110 is concealed in the sole 1100.

Figure 6:
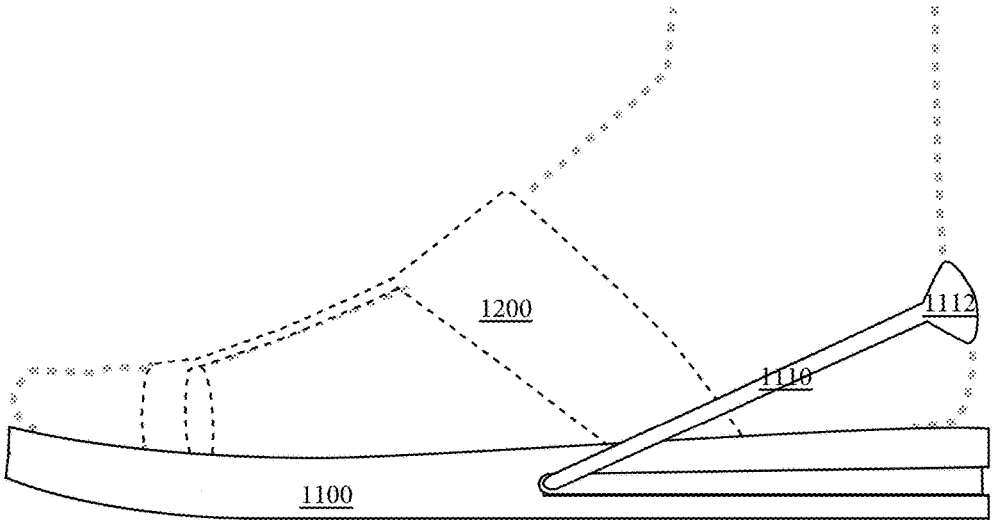
FIG. 6 is an environmental side view of the sandal in an alternate configuration.
Figure 7:
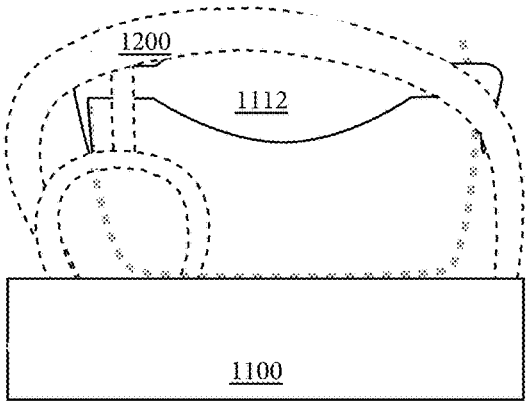
FIG. 7 is an environmental front view of the sandal in the alternate configuration.
Figure 8:
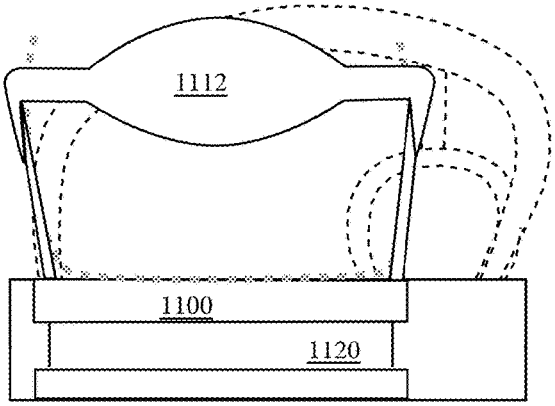
FIG. 8 is an environmental rear view of the sandal in the alternate configuration.

FIG. 6 is an environmental side view of the sandal in an alternate configuration where the heel strap 1110 is revealed. FIG. 7 is an environmental front view of the sandal in the alternate configuration. FIG. 8 is an environmental rear view of the sandal in the alternate configuration. As shown in FIGS. 6 through 8, the sandal 1000 in the alternate configuration comprises the sole 1100 with a strap channel, an upper 1200, and a revealed strap 1110 that has padding 1112.

Figure 9:
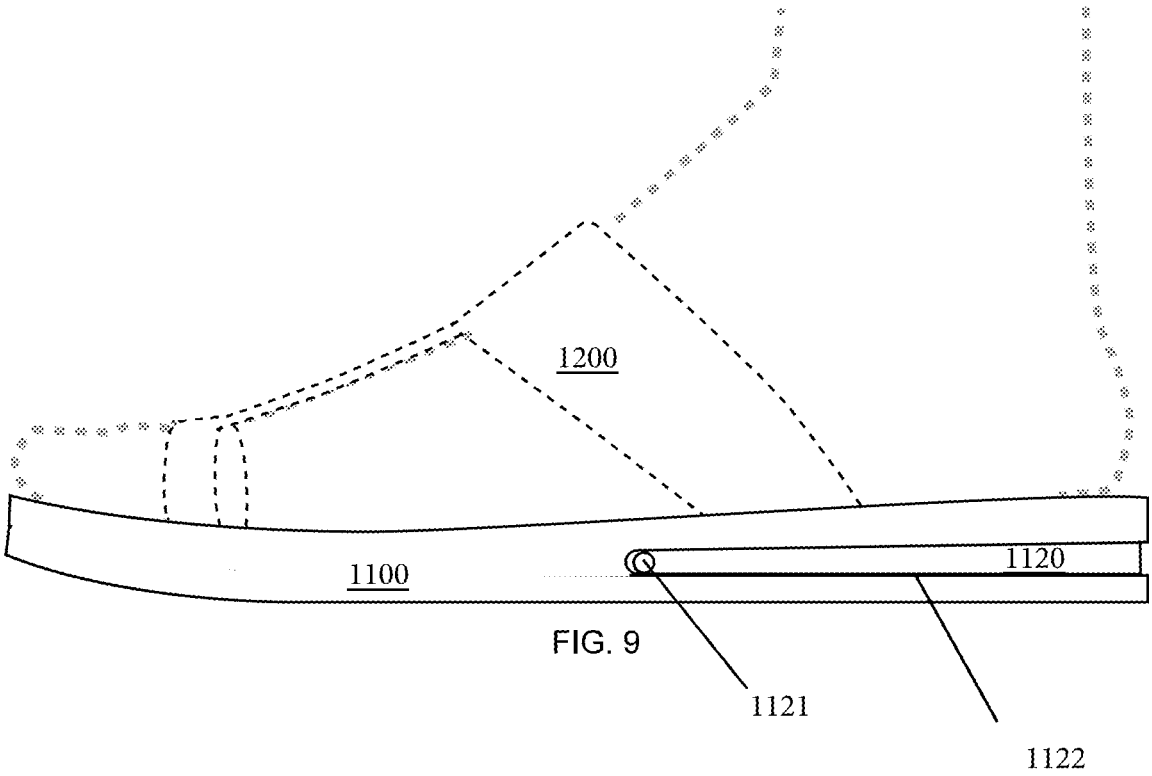
FIG. 9 is a side view of a sandal with the optional use heel strap removed; and, FIG. 10 is a schematic of the optional use heel strap.

Still referring to FIGS. 9 through 8, the sole 1100 is best seen in FIGS. 1, 2, 3 and 4, the upper is best seen in FIGS. 1, 2, 3, and 5, and the heel strap 1110 is best seen in FIGS. 1 and 3. As shown, the sole 1110 is still typically shaped like a human foot and features a strap channel 1120 disposed around the periphery of the heel portion of the sole 1100. As shown, a heel strap 1110 is revealed with padding 1112 positioned over a heel of a wearer.

Comparing FIGS. 1 through 5 through FIGS. 6 through 8, the strap 1110 can be concealed in the strap channel 1120 during periods of non-use or else be provided over the heel of a wearer during periods of use. Suitably, pull tab 1111 is accessible at the heel of the sole 1100 so that the strap may be removed from the strap channel 1120. Suitably, the padding 1112 is unfurled from the pull tabs 1111 after the strap 1110 is pulled out of the strap channel 1120. Once unfurled, the padding 1112 may be provided over the heel of a wearer.

FIG. 9 is a side view of a sandal with the optional use heel strap removed. As shown, the sole 1100 may be provided with a hole 1121 so that the strap may be fastened to the slip-on sandal 1000. Suitably, the hole may be provided through the sole 1100 or the sole may be split 1122 and the strap 1110 (not shown in FIG. 10) sandwiched into the strap channel 1120.

Figure 10:
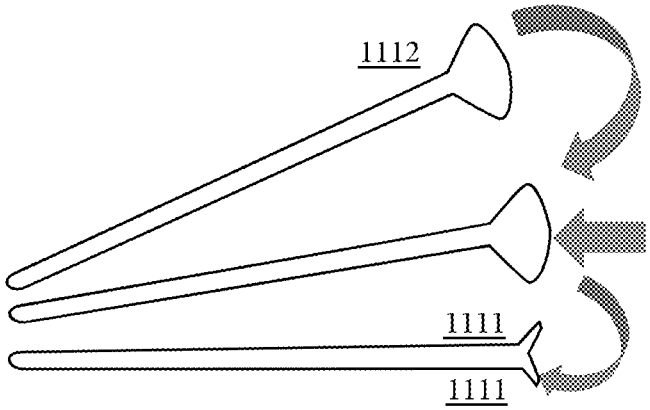

FIG. 10 is a schematic of the optional use heel strap 1110. As shown the padding 1112 may be unfurled in an upright position to define a cup-like heel pad. The padding 1112 may be reverse folded (e.g., by somewhat turning the cup-like heel pad inside out) to create at least one pull tab 1111. Suitably, the padding 1112 may feature a bias to a configuration of a heel pad wherein the strap channel defeats the bias to hold the padding in a folded state to expose the pull tabs. See, e.g., FIG. 1. In one embodiment, the strap is made of rubber or other elastomeric materials.

Although the method and apparatus is described above in terms of various exemplary embodiments and implementations, it should be understood that the various features, aspects and functionality described in one or more of the individual embodiments are not limited in their applicability to the particular embodiment with which they are described, but instead might be applied, alone or in various combinations, to one or more of the other embodiments of the disclosed method and apparatus, whether or not such embodiments are described and whether or not such features are presented as being a part of a described embodiment. Thus the breadth and scope of the claimed invention should not be limited by any of the above-described embodiments.

Terms and phrases used in this document, and variations thereof, unless otherwise expressly stated, should be construed as open-ended as opposed to limiting. As examples of the foregoing: the term "including" should be read as meaning "including, without limitation" or the like, the term "example" is used to provide exemplary instances of the item in discussion, not an exhaustive or limiting list thereof, the terms "a" or "an" should be read as meaning "at least one," "one or more," or the like, and adjectives such as "conventional," "traditional," "normal," "standard," "known" and terms of similar meaning should not be construed as limiting the item described to a given time period or to an item available as of a given time, but instead should be read to encompass conventional, traditional, normal, or standard technologies that might be available or known now or at any time in the future. Likewise, where this document refers to technologies that would be apparent or known to one of ordinary skill in the art, such technologies encompass those apparent or known to the skilled artisan now or at any time in the future.

The presence of broadening words and phrases such as "one or more," "at least," "but not limited to" or other like phrases in some instances shall not be read to mean that the narrower case is intended or required in instances where such broadening phrases might be absent. The use of the term "assembly" does not imply that the components or functionality described or claimed as part of the module are all configured in a common package. Indeed, any or all of the various components of a module, whether control logic or other components, might be combined in a single package or separately maintained and might further be distributed across multiple locations.

Additionally, the various embodiments set forth herein are described in terms of exemplary block diagrams, flow charts and other illustrations. As will become apparent to one of ordinary skill in the art after reading this document, the illustrated embodiments and their various alternatives might be implemented without confinement to the illustrated examples. For example, block diagrams and their accompanying description should not be construed as mandating a particular architecture or configuration.

All original claims submitted with this specification are incorporated by reference in their entirety as if fully set forth herein.

PAPER "SEQUENCE LISTING"

Not applicable.

I claim:

1. A method of wearing a slip-on sandal comprising the steps of:

ensuring that the slip-on sandal comprises:

an upper;

a sole with a strap channel and a hole;

a padded optional use strap that is provided to the strap channel and the hole;

wherein the padded optional use strap is outfitted with a heel padding that is disposed in the strap channel;

wherein the heal padding is reverse folded into two pull-tabs and the padded optional use strap is disposed through the hole and within the strap channel so that the two pull-tabs are extended from the strap channel;

placing a foot within the upper and above the sole;

gripping the two pull tabs;

removing the optional use strap and the heel padding from the strap channel by pulling the tab;

unfolding the heel padding by pulling one of the two pull tabs;

pivoting the heel padding around the hole via the padded optional use strap so that the heel padding is positioned over a heel;

placing the heel padding on the heel of the foot so that the heal padding is spaced from the sole;

gripping the heel padding and pulling the pull heel padding away from the heel of the foot;

disposing the padded optional use strap and a central portion of the heel padding into the strap channel;

contacting a top side of the heel padding with an upper edge of the strap channel so that the top side of the heel padding remains reverse folded to create a first pull tab that extends from the strap channel while the top side of the heel padding is in contact with the upper edge of the strap channel contacting a bottom side of the heel padding with a lower edge of the strap channel so that the bottom side of the heel padding remains reverse folded to form a second pull tab that extends from the strap channel while the bottom side of the heel padding is in contact with the bottom edge of the strap channel; and, removing the foot from the upper and off of the sole.

2. The method of claim 1 wherein the sole is shaped like a human foot, the strap channel is defined in the periphery of a heel portion of the sole and the padded optional use strap is secured by partially being strung through the sole.

3. The method of claim 2 wherein the upper is defined by a toe hole and a foot strap.

4. The method of claim 3 wherein the strap channel holds the heel padding in a reverse fold so that the heel padding is retained within the strap channel while it is inside out.

5. The method of claim 4 wherein the optional use strap is made of rubber and outfitted with padding that sits flush to the sole when stored forward or backward in the sole.

* * * * *